United States Patent [19]

Fassbinder

[11] 4,261,551

[45] Apr. 14, 1981

[54] METHOD AND MEANS FOR SUPPLYING NOZZLES WITH GASEOUS AND/OR LIQUID HYDROCARBONS

[75] Inventor: Hans-Georg Fassbinder, Sulzbach-Rosenberg, Fed. Rep. of Germany

[73] Assignee: Eisenwerk-Gesellschaft Maximilianshutte mbH., Sulzbach-Rosenberg, Fed. Rep. of Germany

[21] Appl. No.: 47,966

[22] Filed: Jun. 12, 1979

[30] Foreign Application Priority Data

Jun. 13, 1978 [DE] Fed. Rep. of Germany ..... 2825851

[51] Int. Cl.[3] ..... C21B 7/16

[52] U.S. Cl. ..... 266/47; 75/52; 75/60

[58] Field of Search ..... 266/47; 75/52, 60

[56] References Cited

U.S. PATENT DOCUMENTS

| | | | |
|---|---|---|---|
| 3,706,549 | 12/1972 | Knuppel | 75/60 |
| 3,771,998 | 11/1973 | Knuppel | 75/60 |
| 4,050,681 | 9/1977 | Brotzmann | 75/60 |
| 4,139,368 | 2/1979 | Schempp | 75/60 |

*Primary Examiner*—P. D. Rosenberg

*Attorney, Agent, or Firm*—Lawrence I. Field

[57] ABSTRACT

The invention describes a method and a means for supplying nozzles comprising concentric pipes with gaseous and/or liquid hydrocarbons in which oxygen or oxygen-containing gases are simultaneously introduced into a converter. In so doing, the gases and/or liquid hydrocarbons are conducted through collecting pipes leading into distribution chambers. They are conducted from the distribution chambers through hydrocarbon volume control devices, which are integrally arranged along with the hydrocarbon distribution devices in a rotatable device element of the rotatable control unit, on to nozzle pipes. Then, the gaseous hydrocarbons are further conducted through a safety control member arranged downstream from the hydrocarbon volume control device. Thus, the even supply of gaseous and/or liquid hydrocarbons to the nozzles is ensured at highly varying throughput rates and alternate supply, in a manner which is simple and reliable.

10 Claims, 4 Drawing Figures

METHOD AND MEANS FOR SUPPLYING NOZZLES WITH GASEOUS AND/OR LIQUID HYDROCARBONS

The invention concerns a method and a means for supplying nozzles comprising concentric pipes with gaseous and/or liquid hydrocarbons in which oxygen or oxygen-containing gases are at the same time introduced through the nozzles into the converter.

The use of unburnt-gas nozzles in converters for steel production, which consist of concentric pipes, is known. Normally, the oxidising unburnt gas—for the most part oxygen—with and without being loaded with powdered flux for making slag, is introduced through the central nozzle pipe, and at the same time hydrocarbons for protecting the nozzles are introduced through one or more of the annular columns. The known Q-BOP method employs such nozzles and these are described, for example, in the German Pat. Nos. 1,583,968, 1,758,816 and 1,966,314.

Furthermore, the German Pat. No. 2,200,413 describes the use of the same nozzles in a converter above the surface of the bath. In this case, gaseous and/or liquid hydrocarbons are also used as a protective medium for the nozzles.

The German patent application No. P 27 56 432 concerns a method for increasing the amount of scrap iron used in the production of steel in the Q-BOP converter. In this method, the conventional oxygen supply nozzles are first of all operated as oil-oxygen burners for preheating the scrap. After the converter has been charged with hot metal, the conventional refining process is carried out and gaseous hydrocarbons, e.g. methane and propane, are used as a protective medium for the nozzles. Important advantages in view of the construction of the nozzles result from this method. The oil quantities necessary for pre-heating the scrap, which of course are higher than the amount of protective medium for the nozzles required, can be introduced through the same annular passages of the oxygen-supply nozzles as are used for the gaseous hydrocarbons when refining the steel. The use of the gaseous hydrocarbons as protective media in steel production has shown good results, in operational use, while at the same time oil products are particularly suitable for pre-heating scrap iron.

The alternate supply of the nozzles with different gaseous and/or liquid hydrocarbons has given rise to some difficulties in practical operation. The German Pat. No. 2,161,000 describes a method and a means for the even distribution and alternate supply of liquid or gaseous protective media for unburnt-gas nozzles in a converter. This method, however, has proved to be insufficiently reliable when used in a steel works. The reliable supply of hydrocarbons to the nozzles during the charging period without any interruption is a necessary prerequisite because as soon as these conditions are not fulfilled, the nozzles will burn back and give to time-consuming repair work which results in corresponding periods of stoppage in production. The resulting economic disadvantages are quite considerable. In particular, the multiple change-over valves and the control devices in the hot region of the converter have proved to be susceptible to trouble. Furthermore, control valves with sleeve valve devices, as are described in the known method for changing over from gaseous to liquid hydrocarbons, sometimes tend to give rise to the freezing of the sleeve valve in the slideways.

A further means for achieving a controlled supply of an unburnt gas and a liquid protective medium in accordance with the German Pat. No. 2,326,754 contains considerable improvements for the safety control of the protective medium for the nozzles. However, the check valve, for example, has a similar tendency to become jammed, as is the case when a sleeve valve is used. Furthermore, a lessening of the precision control of the volume of protective medium for the nozzles results.

The use of this known regulating and control device for the supply of gaseous and/or liquid hydrocarbons to the nozzles makes it necessary in the interests of reliable operation to arrange the regulating devices outside the area of the converter because of their sensitivity to heat and to conduct the supply pipes for the protective medium for each nozzle through a multiple rotary transmission at the converter trunnion.

Quite obviously, the technical resources required for these multiple rotary transmissions are very extensive. Normally, 10 to approx. 25 nozzles are used for converter sizes ranging from 50 to 300 tons, and as soon as the alternate supply of gaseous and liquid hydrocarbons to the nozzles is necessary, two pipes leading to each nozzle are required. This implies a rotary transmission with 20 separate passages for just 10 nozzles. The transport of gaseous and liquid hydrocarbons in the same nozzle pipes has proved to be a disadvantage since different pipe cross-sections are required because of the different volumes of the media.

Furthermore, the long pipes from the distribution, control and monitoring devices outside the converter unit through the rotary transmission and from there to the nozzles are a source of trouble. Besides additional sources of trouble, in particular leakages in the rotary transmission, the relatively large pipe volumes give rise to a high degree of sluggishness in the whole of the control system.

It is therefore the object of the invention to provide a method which eliminates the disadvantages described heretofore and which facilitates in a simple and reliable manner the even distribution of gaseous and/or liquid hydrocarbons to the nozzles at very different throughput rates and alternate supply and which at the same time provides safety control members which for the most part react without any degree of sluggishness, at the same time protecting the rotary transmission against gas backflow. This object is solved by a method in which, for the purpose of increasing safety in operation when using gaseous and/or liquid hydrocarbons, the hydrocarbon volume control devices and the distribution devices for the individual supply of gaseous and/or liquid hydrocarbons to the nozzles are combined in one structural unit with the rotary transmission at the converter and in the case of which a safety control member is integrated in each nozzle pipe for the gaseous hydrocarbons downstream from this structural unit.

The method of the invention, in which the hydrocarbon volume control devices separated for gaseous and liquid hydrocarbons and the supply to individual nozzle supply pipes are combined in one structural unit with the rotary transmission at the converter (hereinafter referred to as rotatable control unit) and in which a safety control member with several functions (hereinafter entitled safety control member) is arranged in each of the nozzle pipes downstream from the aforementioned structural unit, has a number of advantages over the known method for supplying hydrocarbons to the nozzles. Until reaching the rotatable control unit, the hydrocarbons are conducted in a single main supply pipe only.

As soon as it is intended to operate while using gaseous and liquid hydrocarbons, single main pipes are installed for the gas, e.g. methane, propane, and for the liquid, e.g. oil, respectively. The single main pipes have a sufficient cross-section for the maximum throughput rate at highly varying throughput volumes. It is also within the scope of the invention to supply only one type of hydrocarbon to the nozzles in accordance with the inventive method. By way of example, it has proved to be successful when using natural gas, i.e. methane, to supply the nozzles with accordingly high amounts for pre-heating scrap iron and to reduce the throughput of hydrocarbon during the refining process to the necessary amount of approximately 6 to 10%, in relation to the amount of oxygen introduced, for the protection of the nozzles. The volume control device in the rotatable control unit facilitates this procedure without any problems arising. An analogous procedure can be adopted when using liquid hydrocarbons, e.g. oil.

The inventive method has particular advantages in the case of the alternate use of gaseous and liquid hydrocarbons. In this method of operation, the rotatable control unit has two separate control and distribution devices. The volume control device for the hydrocarbons may be controlled in any manner as required during operating time. It functions synchronously for all nozzles in the converter.

A further advantage of the inventive method is to be seen in the relatively short individual supply pipes for liquid and/or gaseous hydrocarbons to every nozzle. Starting from the rotatable control unit at the converter trunnion, only the short distances between the converter trunnion and the nozzles need to be bridged by corresponding pipes for each nozzle. These individual nozzle supply pipes can be designed so as to have a minimum cross-section with the result that, for instance, a maximum pressure loss for gaseous hydrocarbons amounting to approximately 1.2 bars and for liquid hydrocarbons amounting to approximately 2 bars will not be exceeded at the highest throughput rates. Relatively low volumes in the pipes are the result, and these low volumes have a favourable effect on the total control system. First, because the control reacts almost without any sluggishness, and, second, because when changing over to nozzle cooling media which are free from hydrocarbons, e.g. nitrogen, air, argon, during the turnround times of the converter only short portion of the pipes need to be blown free, i.e. the residual amounts of hydrocarbons in the individual nozzle pipes are small.

The rotatable control unit of the invention comprises a stationary housing, which may, for instance, be rigidly connected to the supporting bracket of the converter, and a rotatable device element the whole or at least part of which is centrally supported in the stationary housing. In accordance with the invention, the rotatable device element is mounted on the converter trunnion, thus conforming to the rotary movement of the converter.

The rotatable device element basically comprises the volume control members which are integrated with the distribution device for the individual nozzle supply pipes for gaseous and/or liquid hydrocarbons. The volume control is carried out in a manner known per se by changing the flow cross-section before the introduction of the hydrocarbons into the individual nozzle supply pipes. The change of the cross-section is effected through the action of a control piston which is sealed off from the stationary housing by means of conventional seals and with intermediate vents. The axial movement of the piston acts on a pressure-controlled membrane disc which is activated by a conventional electropneumatic control unit in the stationary housing. In accordance with the invention, this membrane disc is connected to the control piston via an axial bearing.

An advantageous embodiment of the inventive means is seen in embodying the aforementioned control piston to function directly as a hydraulic piston. The axial movements of the control piston are then caused by the pressure of a hydraulic liquid between the stationary housing part and the rotatable control piston. The pressure of the hydraulic liquid necessary for producing the desired axial movements of the control piston is set by means of an ordinary commercial electropneumatic control means or hydraulic control unit. This structure eliminates the aforementioned axial bearing in connection with the diaphragm disc for transmitting the movement of the diaphragm disc to the control piston.

In accordance with the invention, the safety control members in the individual supply pipes for gaseous hydrocarbons are connected to the rotatable device element on the rotatable control unit. Thus, there remains only the necessity to transmit the necessary control pressure for the safety control members from the stationary to the rotatable portion of the control unit. In like manner, electric signals for monitoring and control purposes can be transmitted in an uncomplicated manner from the safety control members to the rotatable control unit via corresponding electric sliding contacts. In accordance with the invention, the rotatable control unit can be provided with a passage arranged centrally in the revolution axis. This central passage is sealed off from all systems of the rotatable control unit so as to be gasproof. The passage may, for instance, be used as an additional supply pipe for the converter for all kinds of media or as a measuring pipe. Furthermore, the central passage can incorporate several pipes, for instance concentric pipes, which are also sealed off from one another. Thus, for instance, it has proved to be expedient to conduct three pressure-measuring pipes, embodied as concentric pipes, through the central bore of the rotatable control unit for supervision measurements at the bottom nozzles of a converter.

The safety control member in each nozzle pipe for the gaseous hydrocarbons is a combination of pressure limiting and check valve with differential pressure monitor in mutual relationship. Fundamentally, it has three movable discs at its disposal whose positions are determined in accordance with the pressures existing in five surge chambers which are separated from one another. On the one hand, this safety control member regulates the pressure of the gaseous hydrocarbons at the nozzles and the existing oxygen pressure at each nozzle and, on the other hand, it functions at the same time as a check valve as soon as oxygen, i.e. a higher pressure, enters the annular passage of the nozzle. Beyond this, it controls the throughput volume of gaseous hydrocarbons through the nozzles, this supervision being carried out by comparing the pressure of the gas in front of and behind the volume control member. An electric warning or control signal is released as soon as this difference in pressure falls below a certain minimum value.

In accordance with the invention the pressure differential may also be transmitted and monitored as an analogous value. Thus, the supply of hydrocarbons to the nozzles and the functioning of the safety control members can be controlled in a simple manner.

The inventive method will be explained in detail hereinafter by means of examples and exemplary preferred embodiments of the means and with reference to the drawings in which FIG. 1 shows a cross-sectional view of the rotatable control unit which is designed for gaseous and liquid hydrocarbons in this embodiment example;

Figure 1:
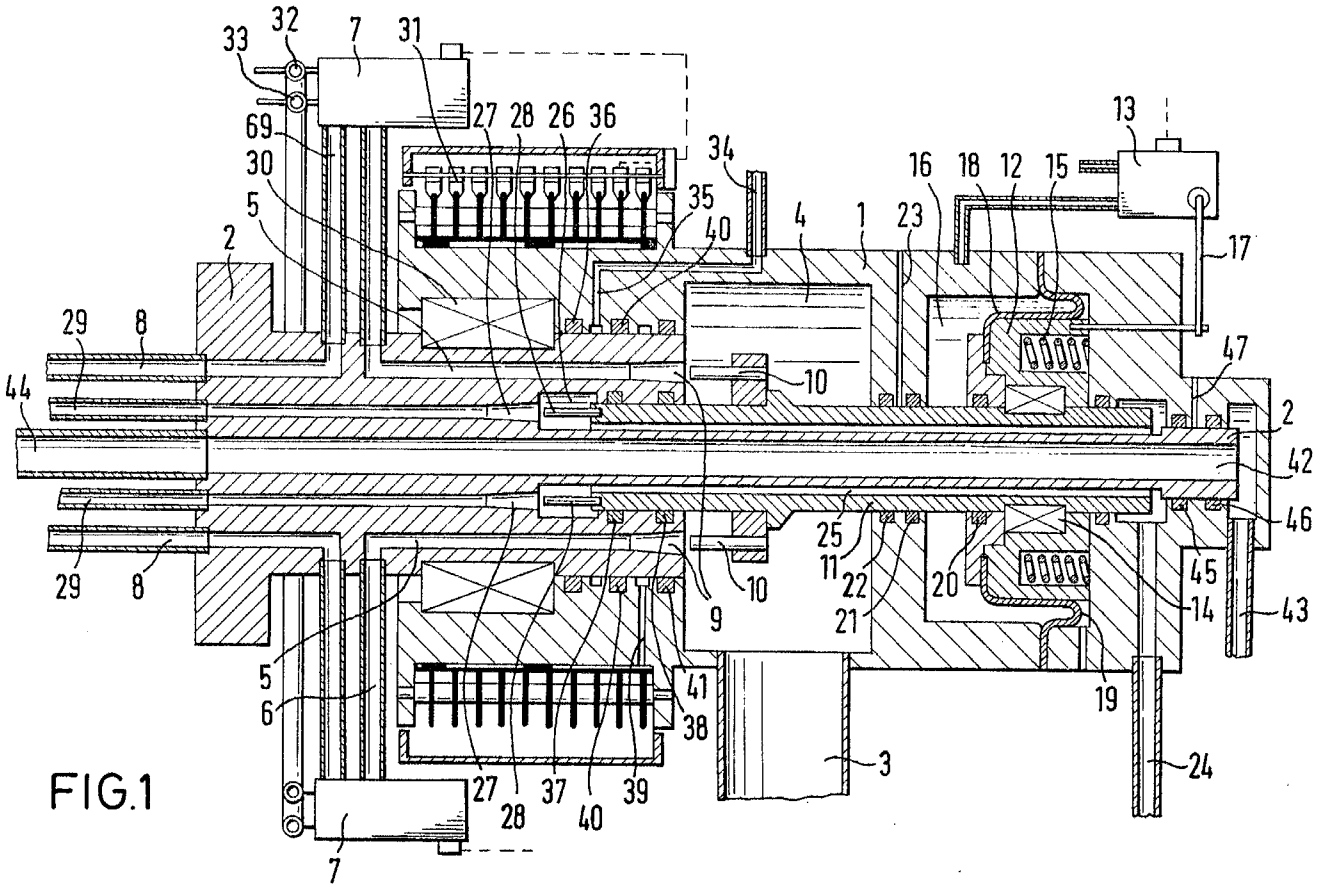

The rotatable control unit in FIG. 1 comprises a stationary housing 1 (shaded slantwise in FIG. 1) and a rotatable device element 2 (crosshatched in FIG. 1). The supply pipe 3 for the gaseous hydrocarbons is welded to the stationary housing 1. The gaseous hydrocarbons flow from the distribution chamber 4 through the bores 5 arranged in the rotatable device element to the connection pipes 6 in the safety control member 7 and from there into the individual nozzle pipes for gaseous hydrocarbons 8. The safety control members 7 in each nozzle pipe for gaseous hydrocarbons are rigidly connected to the rotatable device element 2 and, as a result, they also conform to the rotary motion of the converter.

The volume control members at the openings for the hydrocarbons flowing from the distribution chamber 4 into the bores 5 comprise a tapered bore 9 in which regulating pins 10 are received. The insertion depth of the regulating pins 10 in the tapered bores 9 controls the free cross-section for the gaseous hydrocarbons which determines the gas volumes. The regulating pins 10 are rigidly connected to the control piston 11 which is movable axially. In so doing, the control members have both the function of a control valve for the total rate of flow of protective media and also the function of equally alloting this quantity of flow to the individual nozzles.

The axial shift of the control piston 11 takes place through the action of a pneumatic control which is known per se and fundamentally comprises a diaphragm disc 12 and a control unit 13. The diaphragm disc 12 is coupled via a thrust bearing 14 with the control piston. When the convertor is not in operation, a spring 15 presses the diaphragm disc 12 in the direction of the axis into a surge chamber 16 until the regulating pins 10 close the tapered bores. When in operation, the electro-pneumatic control unit 13 regulates the pressure in the surge chamber 16 in such a manner that the diaphragm disc 12 assumes the desired position, this position being then electrically signaled to the control unit 13. The control unit 13 controls the desired position of the diaphragm disc 12 by means of a mechanical remote-position indicator 17 connected to the control unit 13. The surge chamber 16 is sealed off from the pressureless chamber 19, also containing the spring, by means of a diaphragm 18.

The remaining seals, e.g. 20, between the operating cylinder and the diaphragm disc are embodied as conventional sealing means. In order to ensure the prevention of an overflow of different media from one chamber into another, e.g. from the surge chamber 16 into the distribution chamber 4 for gaseous hydrocarbons, the advantageous combinatin of two seals with a pressureless intermediate vent is embodied, e.g. seals 21, 22 and intermediate vent 23.

The liquid hydrocarbons are fed through a supply pipe 24 to the rotatable control unit. They flow through an annular channel 25, provided in the rotatable device element, on to a distribution chamber 26 for liquid hydrocarbons. They flow from there through the volume control members, comprising tapered bores 27 and regulating pins 28, into individual nozzle pipes 29. The same pneumatic control unit 13, in connection with the diaphragm disc 12 and control piston 11, carries out the volume control of the liquid hydrocarbons.

Accordingly, in the supply of the converter nozzles with gaseous and liquid hydrocarbons, a pipe 8 for gaseous hydrocarbons and a pipe 29 for liquid hydrocarbons lead to each nozzle. Each of these pipes correlates with a volume control member comprising tapered bores 9, 27 and regulating pins 10, 28. The rotatable device element 2 is supported via thrust bearings 30 by the stationary housing 1.

The indicator and control voltages are transmitted from the rotatable device element 2 to the stationary housing 1 by means of a sliding contact unit 31. The sliding contact unit 31 is required for transmitting the electric signals from the individual safety control members. The control pressure for the pipe 32 leading to the safety control member is applied through the supply pipe at the stationary housing to the rotatable device element 2 and from there to the safety control member 7. Such a supply path is partially illustrated. The pressure between the two seals 36, 40 is applied to the rotatable device element 2 through a connection 34 and a bore 35 provided in the stationary housing 1 and is passed on to the pipe 32 of the safety control member 7 through a bore (not shown) in the rotatable device element 2, whereas the pressure in the connecting pipe 33 is the same as in the distribution chamber 4, this pressure equalisation being produced by a further bore (not shown) in the rotatable device element 2. A pipe 69 leads to the nozzle pipe 8 from the safety control member 7.

As already explained, different media chambers with double seals and intermediate vents are sealed off from one another. By way of example, an intermediate vent (not shown) is also arranged between the seals 37 and 38 which seal off the axially movable control piston between distribution chambers for liquid hydrocarbons 26 and gaseous hydrocarbons 4. This intermediate vent is similar to the intermediate vent 39 shown between the two seals 40 and 41.

The rotatable control unit illustrated further has a central bore 42. The connections 43 and 44 for the central bore 42 are situated on the stationary housing 1 and on the rotatable device element 2 respectively. Another medium or a control pressure can be applied to the converter through this pipe which is completely sealed off from the other systems of the rotatable control unit by means of seals 45 and 46 and an intermediate vent 47, or this connection pipe can be used for pressure measurement at the converter.

It is further within the meaning of the invention to conduct one or more concentric pipes through the bore 42 and to seal these off from one another as is illustrated in the case of the bore 42.

The rotatable control unit in FIG. 1 is a preferred embodiment of the inventive means for supplying gaseous and liquid hydrocarbons to the converter nozzles. It may also be applied in the case of two different gaseous or two different liquid hydrocarbons. The cross-sections for the regulation of the volume must of course be adapted to suit the throughput rates.

The rotatable control unit may also be used for one type of hydrocarbons, e.g. liquids or gases. It has proved to be an advantage to use an accordingly simplified embodiment of the rotatable control unit for supplying a converter with one type of hydrocarbons. In this case, only one set of volume regulation members and only one individual pipe for each nozzle is required.

Figure 2:
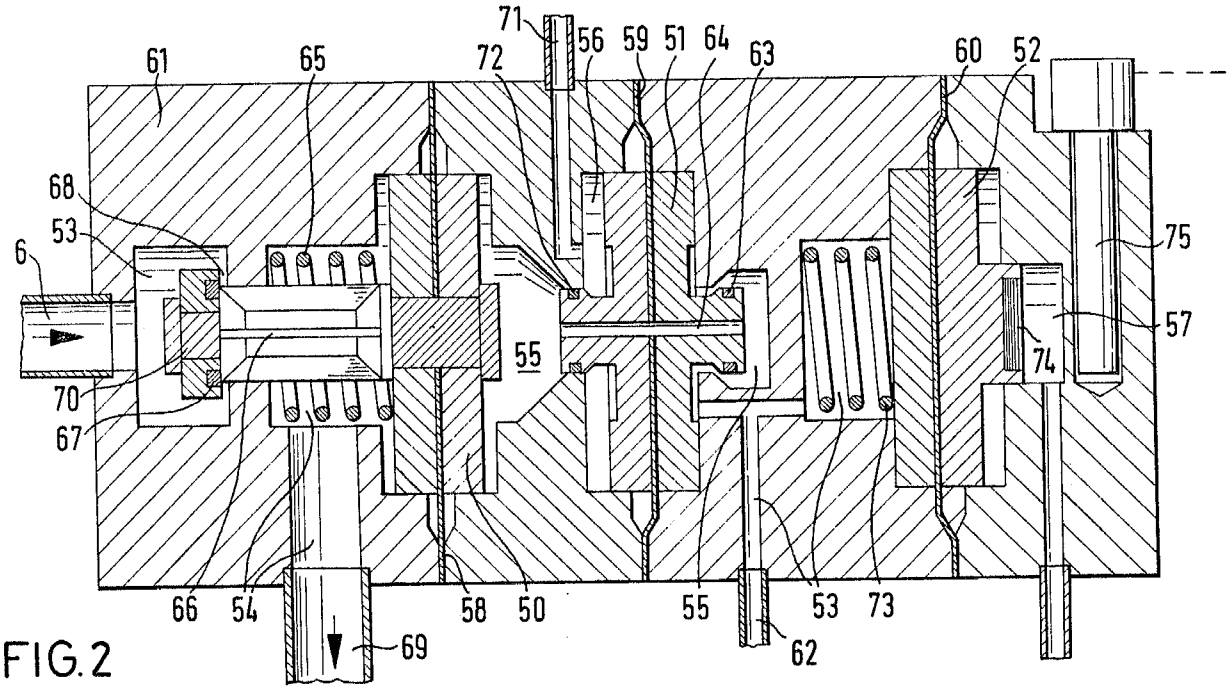
FIG. 2 shows a cross-sectional view of the safety control member for gaseous hydrocarbons.

The safety control member 7, illustrated in FIG. 2, fundamentally comprises three diaphragm discs 50, 51 and 52 and five surge chambers 53, 54, 55, 56 and 57 which are sealed off from one another. Each of the three diaphragm discs 50, 51, 52 is sealed off from the housing 61 of the safety control member by means of sealing membranes 58, 59, 60.

The pre-set amount of hydrocarbon for the individual nozzle flows from the rotatable control unit through the connection pipe 6 to the safety control member. Accordingly, the same gas pressure exists in the surge chamber 53 and in the supply pipe 6. This pressure is also signaled to the surge chamber 53 at the diaphragm disc 52 via a connection 62.

In the usual operating position of the systems in the safety control member shown, the pressure in the surge chamber 53 is the same as in the surge chamber 55. The path of conduction leads through a connection 62, past an open seal 63 and through a bore 64 in the diaphragm disc 51 to the surge chambers 53 and 55. The diaphragm disc 50, which works against the force of a spring 65, clears a gate port 68 at the seal 67 via a connecting piece 66. The hydrocarbon gas flows through this gate port 68 out of the connection pipe 6 through the surge chamber 53 into the surge chamber 54, leaving the latter through the exhaust port 69 to finally arrive at the nozzle through the individual nozzle pipes 8.

Since at this switch position of the diaphragm disc 51 the same pressure exists in surge chamber 55 and in surge chamber 53, the safety control member now functions as a servo-controlled check valve. This is due to the fact that the input pressure via 55 acts on the membrane 58 so as to open it and the output pressure via 54 works on a valve disc 70 so as to close it. The spring 65 has an additional closing effect. A balance of forces is achieved when the input pressure 55 is 0.2 bar higher than the output pressure 54; the spring 65 is designed accordingly. Thus, a constant fall in pressure of 0.2 bar is obtained at the gate port. In this manner, a backflow of media from the surge chamber 54 into the surge chamber 53, i.e. in the opposite direction of flow, can be avoided with certainty.

The surge chamber 56 communicates with the oxygen pressure of the nozzle via a delivery pipe 71. Normally, the oxygen pressure is signaled to the surge chamber 56 via a pressure transmitter with an inert gas, e.g. nitrogen.

A further function of the safety control member is to be seen in the fact that the hydrocarbon pressure in the surge chamber 54 is compared with the oxygen pressure at the nozzle, and in all events the hydrocarbon pressure must be set lower than the oxygen pressure. As soon as a pressure in the surge chamber 56 exists which is lower than the pressure in the surge chamber 53, the diaphragm disc 51 changes its position as illustrated and a seal 72 opens to allow the surge chamber 56 to communicate with the surge chamber 55. At the same time, the seal 63 closes and cuts off the supply from the surge chamber 53 to the surge chamber 55 via the connection 62. The diaphragm disc 51 works with a so-called flip-flop characteristic, i.e. it either closes seal 63, in so doing opening seal 72, or vice versa.

When surge chambers 56 and 55 communicate with each other, the diaphragm disc 50 compares this pressure with the pressure in surge chamber 54 in the manner described, the hydrocarbon gas being able to proceed from surge chamber 53 through the gate port 68 to surge chamber 54 only after a sufficiently large difference in pressure between the two surge chambers has been brought about. In other words, through the interaction of the diaphragm discs 50 and 51, the respective lowest pressure from the surge chambers 53 or 56 becomes effective to set an adequate difference in pressure between surge chambers 54 and 55, i.e. the pressure of the hydrocarbon gas in the pipe 69 is lower than the lowest gas pressure in surge chamber 53 or 56 respectively in all cases of operation.

Finally, the safety control member of the invention also supervises the throughput volume of the gaseous hydrocarbons emitting a signal as soon as it falls below a certain minimum amount. To carry out this function, the pressure of the gaseous hydrocarbons existing in front of the volume control member in the rotatable control unit situated in the distribution chamber 4 is applied to surge chamber 57. As long as the pressure in surge chamber 57 is higher than in surge chamber 53, the diaphragm disc 52 remains in the position shown in the drawing. This is the normal case of operation. As soon as the pressure in surge chamber 53 approaches the pressure in surge chamber 57, i.e. as soon as a sufficiently high fall in pressure at the volume control member 9, 10 no longer exists, the diaphragm disc 52 changes its position, being supported in so doing by the force of a spring 73. At this point, a permanent magnet 74 approaches an ignition switch 75 and switches on an electric signal.

The difference in pressure at the volume control member is a direct measure of the throughput volume of gaseous hydrocarbons. It has proved to be an advantage in practical operation to release this signal at a difference in pressure of 1.05 bars which can be set by an accordingly adapted spring 73. The electric signal is conducted to any desired monitoring position, e.g. in the converter command post, via the sliding contact unit 31 on the rotatable control unit already described.

In accordance with the invention, the pressure differential between surge chambers 57 and 53 may also be analogously transmitted and monitored. Diaphragm disc 52 then assumes the function of an ordinary measuring device for pressure differential. The analogous monitoring of pressure differential instead of a signal at critical pressure differential is one way of continuously controlling the supply of hydrocarbons to the nozzles and the functioning of the safety control.

The safety control member in FIG. 2 shows in particular the manner in which the control elements for pressure limitation are combined with the servo check valve and the differential pressure monitor. The structural embodiment of this construction unit will of course differ from this drawing which is to a large extent schematic. By way of example, the connections for the gaseous hydrocarbons and the control pressures are combined on one level. The connections between the individual surge chambers are effected to a large extent by means of bores in the housing. Furthermore, double membranes are employed to achieve improved control of the diaphragm disc and to support the control function. Alternative embodiments, particularly in view of the structural embodiment of the safety control member, are within the scope of the invention.

The arrangement of the safety control member upstream from the nozzle in front of the rotatable control unit has—apart from the special features already described—a further important advantage. If, when operating the nozzles, gases under high pressure, e.g. oxygen, flow into the nozzle supply pipes, the safety control member reacts in the manner described, e.g. as a servo check valve, thus protecting the rotatable control unit. In practical operation heretofore, the accomodation of similar control and monitoring devices in chambers situated at a distance from the converter, where there was no longer any risk of a dangerous rise in temperature inside them, has proved to be a particular disadvantage. In the case of breakdowns in operation, damage occurs at the relatively complicated multiple rotary transmissions.

Figure 3:
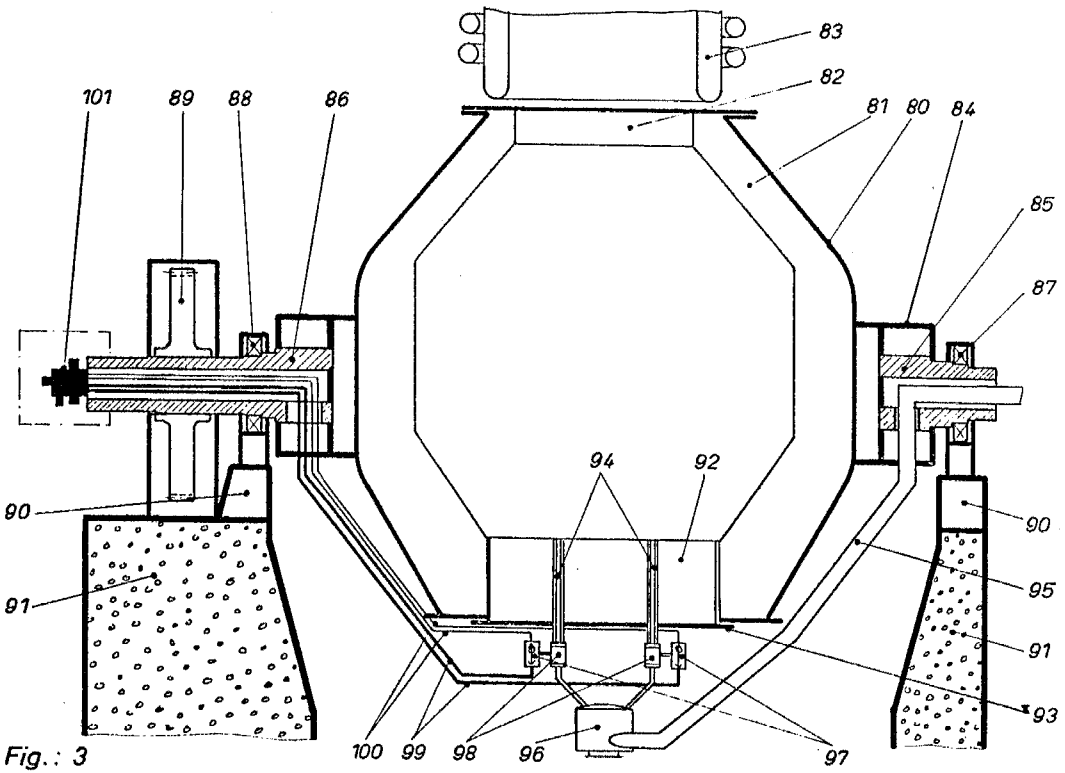
FIG. 3 shows a cross-sectional view of the converter with the inventive supply means.

FIG. 3 shows an oxygen blower converter comprising a steel plate casing 80 with refractory lining 81. A gas collecting hood 83 is arranged above converter opening 82 and this hood supplies the flue gases from the converter to the gas purifying plant (not shown). Converter 80 is frictionally connected to a converter lip ring 84. Two pivots 85 and 86 are arranged at converter lip ring 84. Pivots 85 and 86 are pivoted in bearings 87 and 88 and facilitate the rotary motion of the converter. The driving force for the rotary motion of the converter is produced by motors and gears in structural unit 89. Converter driving unit 89 and bearings 87 and 88 are rigidly connected to the concrete foundation 91 by means of assembly stands 90.

Nozzles 94 are arranged in the bottom lining 92 on bottom plate 93 of the oxygen blower converter. The central pipes of nozzles 94 comprising two concentric pipes are supplied with oxygen and powdered slag-forming addition via supply pipe 95 and suspension distributor 96. Supply pipe 95 leads through pivot 85 and a rotary transmission (not shown) to suspension distributor 96.

The annular passages of nozzles 94 are supplied with liquid or gaseous hydrocarbons. The pressure-controlled switch valve 97 at nozzle flange 98 switches over the hydrocarbon supply, dependent on the pressure. Each nozzle has a separate pipe for gaseous 99 and liquid hydrocarbons 100. Nozzle supply pipes 99, 100 for gaseous and liquid hydrocarbons are lead upstream through converter pivots 86 to the control means 101 of the invention. The means 101 is illustrated approximately true to scale and is rigidly connected with converter pivot 86.

Figure 4:
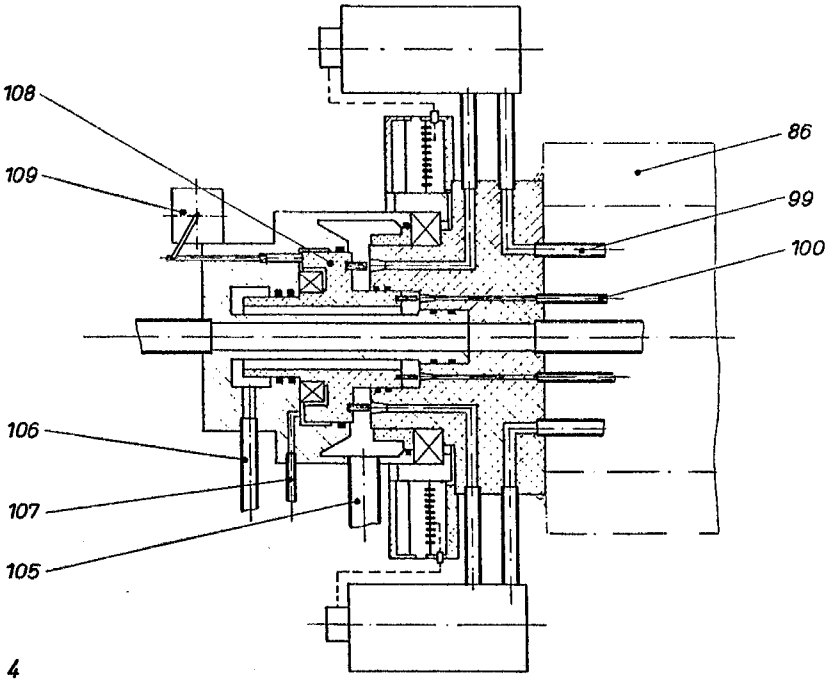
FIG. 4 shows a cross-sectional view of a further embodiment of the supply means.

FIG. 4 shows a further embodiment of the means for supplying gaseous and/or liquid hydrocarbons to the nozzles. The means is supplied with gaseous hydrocarbons through supply pipe 105 and with liquid hydrocarbons through supply pipe 106. The hydraulic liquid is supplied to the means through pipe 107. Control piston 108 of the means is moved in an axial direction in accordance with the control signals and is controlled by means of hydraulic control unit 109. The remaining functions of the means shown in FIG. 4 correspond to those shown in FIG. 1.

The mode of operation of the inventive means will be described hereinafter.

A Q-BOP converter with a holding capacity of 60 tons and with 10 bottom nozzles is used in the production of steel where a large amount of scrap iron is used. For this purpose, the empty converter is first charged with 22 tons scrap and the bottom nozzles are used as an oil-oxygen burner for preheating.

During the period of pre-heating the scrap, the oil supply pipe 24 leading to the rotatable control unit is charged with oil at a rate of 75 l/min at a pressure of 31 bars. This volume of oil is evenly distributed to the annular channels of the 10 nozzles through the volume control members 27 and 28. The oil passes through the individual supply pipes 29 to a T relay at the end of the nozzle which opens the way to the annular column of the nozzle due to the accumulated pressure. The free cross-section between the tapered bore 27 and the regulating pin 28 amounts to approx. 2 $mm^2$ and the fall in pressure amounts to approx. 26 bars. The nozzles are at the same time supplied with oxygen at an amount totaling 150 $Nm^3$/min in order to burn the oil.

After the expiration of the pre-heating time, the converter is charged with 44 tons hot metal. At this point, the oil supply to the connecting pipe 24 is already interrupted and nitrogen flows through the annular channels of the nozzles and is supplied through the supply pipe 3 and the nozzle supply pipes 8. The pressure-controlled T relay at the nozzle flange has already switched over at this point since now the higher pressure accumulates at the individual nozzle supply pipes for gas.

As soon as the converter is in refining position, propane flows through the supply pipe 3 at a rate of 350 $Nm^3$/h and at a pressure of 8 bars. The regulating pins 10 combined with the tapered bores 9 open a cross-section amounting to approx. 10 $mm^2$ for each nozzle supply pipe. The fall in pressure of the volume control unit amounts to approximately 4 bars. The propane proceeds through the safety control members to the nozzles. The safety control members function in the manner illustrated in FIG. 2 and described heretofore. The fall in pressure between surge chambers 53 and 54 amounts to approx. 1.2 bars. The steel melt is produced after a refining period of approx. 10 minutes and the converter turns into the position for tapping. As in the case of charging, nitrogen then flows through the nozzle channels.

What is claimed is:

1. A means for supplying nozzles comprising concentric pipes with hydrocarbons and oxygen-containing gases simultaneously passed separately through adjacent passages in the nozzles to a convertor, comprising: distribution chambers (4,26) for the hydrocarbons located in a rotatable control unit comprising a stationary housing part (1) and a rotatable device element (2) operatively connected to supply pipes (3, 24) said rotatable device element (2), communicating with the convertor trunnion and being pivotally mounted in said stationary housing part (1), hydrocarbon volume control means, (9, 10; 27, 28) communicating with the distribution means (5, 8; 29), and safety control members (7) arranged between the hydrocarbon volume control means (9, 10) and the nozzle pipes (8) for the hydrocarbons.

2. A means according to claim 1 in which the hydrocarbon volume control means (9, 10, 27, 28) are controlled via a control piston (11, 108) in conjunction with a control unit (13, 109).

3. A means according to any of claims 1 to 2 in which the distribution chambers (4, 25) for different hydrocarbons are sealed off from each other between the housing (1) and the rotatable device element (2) with sealing means and interposed pressureless vent chambers.

4. A means according to any of claims 1 to 3 in which the hydrocarbon volume control means comprise regulating pins (10, 28) which are movable into tapered bores (9, 27).

5. A means according to any of claims 1 to 4 in which one or more sealed passages (42) are provided in the axis of rotation of the rotatable control unit.

6. A means according to any of claims 1 to 5 in which electric sliding contacts (31) are arranged between the stationary housing (1) and the rotatable device element (2) for transmitting control and indication signals.

7. A means according to any of claims 1 to 6 in which the safety control members (7) comprise a combination of pressure-limiting and check valves with differential pressure monitors in mutual relationship and which fundamentally exhibit three movable diaphragm discs (50, 51, 52) and five surge chambers (53, 54, 55, 56, 57) sealed off from one another.

8. A means according to claim 7 in which a pressure, which is at least 1.1 bars lower than the lowest pressure in the chambers (53, 56), is set in surge chamber (54) by means of the diaphragm disc (50).

9. A means according to claim 7 in which an electric signal is released by the diaphragm disc (52) when the volume of the hydrocarbon falls below a certain minimum volume.

10. A means according to claim 7 in which the pressure differential between surge chambers (57, 53) is measured and monitored analogously.

* * * * *